US006727483B2

(12) United States Patent
Thomas et al.

(10) Patent No.: US 6,727,483 B2
(45) Date of Patent: Apr. 27, 2004

(54) METHOD AND APPARATUS FOR DELIVERY OF INDUCTION HEATING TO A WORKPIECE

(75) Inventors: Jeffrey R. Thomas, Appleton, WI (US); Randall G. Baxter, Black Creek, WI (US); Mark A. Ulrich, New London, WI (US); Paul D. Verhagen, Appleton, WI (US)

(73) Assignee: Illinois Tool Works Inc., Glenview, IL (US)

( * ) Notice: Subject to any disclaimer, the term of this patent is extended or adjusted under 35 U.S.C. 154(b) by 309 days.

(21) Appl. No.: 09/940,065

(22) Filed: Aug. 27, 2001

(65) Prior Publication Data

US 2003/0038130 A1 Feb. 27, 2003

(51) Int. Cl.[7] ..... H05B 6/42

(52) U.S. Cl. ..... 219/632; 219/677; 336/62; 174/15.6

(58) Field of Search ..... 219/632, 677, 219/672, 676; 336/57, 60, 62; 174/15.6, 15.1

(56) References Cited

U.S. PATENT DOCUMENTS

| | | | | |
|---|---|---|---|---|
| 2,457,843 A | | 1/1949 | Strickland, Jr. | 174/47 |
| 2,483,301 A | | 9/1949 | Roberds | 174/15 |
| 2,817,066 A | | 12/1957 | Scarpa | 336/84 |
| 2,988,804 A | | 6/1961 | Tibbetts | 29/155.57 |
| 3,022,368 A | | 2/1962 | Miller | 174/15 |
| 3,403,240 A | * | 9/1968 | Henderson et al. | 219/632 |
| 3,492,453 A | | 1/1970 | Hurst | 219/10.49 |
| 3,535,597 A | | 10/1970 | Kendrick | 317/155.5 |
| 3,764,725 A | | 10/1973 | Kafka | 174/15 |
| 3,946,349 A | | 3/1976 | Haldeman, III | 336/62 |
| 4,317,979 A | | 3/1982 | Frank et al. | 219/10.77 |
| 4,339,645 A | | 7/1982 | Miller | 219/10.49 |
| 4,355,222 A | | 10/1982 | Geithman et al. | 219/10.57 |
| 4,392,040 A | | 7/1983 | Rand et al. | 219/10.71 |
| 4,527,032 A | | 7/1985 | Young et al. | 219/10.61 |
| 4,527,550 A | | 7/1985 | Ruggera et al. | 128/1.5 |
| 4,549,056 A | | 10/1985 | Okatsuka et al. | 219/10.77 |
| 4,578,552 A | | 3/1986 | Mortimer | 219/10.41 |
| 4,761,528 A | | 8/1988 | Caillaut et al. | 219/10.491 |
| 4,794,220 A | | 12/1988 | Sekiya | 219/10.491 |
| 4,900,885 A | | 2/1990 | Inumada | 219/10.55 B |

(List continued on next page.)

OTHER PUBLICATIONS

Mannings U.S.A. Brochure—"Induction Bolt Heating Services".

Superheat Services, Inc. Brochure—"On Site Heat Treatment Specialists".

400 Cycle Induction Heating with proportional control for Preheating and Stress Relieving or Welding Joints, Hobart Brothers Co.

Installation, Operation, and Maintenance for High Frequency Induction Heaters, Hobart Brothers Co.

*Primary Examiner*—Philip H. Leung
(74) *Attorney, Agent, or Firm*—Fletcher Yoder

(57) ABSTRACT

A method and apparatus for inducing heat within a workpiece. A flexible fluid-cooled induction heating cable is used to produce a magnetic field to induce electric current in a workpiece. The induction heating cable has separate fluid and electrical connectors to separately couple cooling fluid and electric current to and from the induction heating cable. An induction heating system having a fluid cooling unit, a power source, and a flexible fluid-cooled induction heating cable having separate fluid and electrical connectors. An extension cable may be used to enable the flexible fluid-cooled induction heating cable to be used at a greater distance from the power source and the fluid cooling unit. An insulation blanket adapted for use with a specific size workpiece may be used with the flexible fluid-cooled induction heating cable.

42 Claims, 11 Drawing Sheets

U.S. PATENT DOCUMENTS

| | | | | | |
|---|---|---|---|---|---|
| 4,942,279 | A | | 7/1990 | Ikeda | 219/10.75 |
| 4,963,694 | A | | 10/1990 | Alexion et al. | 174/15.6 |
| 4,975,672 | A | | 12/1990 | McLyman | 336/198 |
| 5,004,865 | A | | 4/1991 | Krupnicki | 174/15.7 |
| 5,101,086 | A | | 3/1992 | Dion et al. | 219/10.491 |
| 5,113,049 | A | | 5/1992 | Border et al. | 219/10.79 |
| 5,185,513 | A | | 2/1993 | Pacileo | 219/497 |
| 5,313,037 | A | | 5/1994 | Hansen et al. | 219/632 |
| 5,343,023 | A | | 8/1994 | Geissler | 219/661 |
| 5,430,274 | A | * | 7/1995 | Couffet et al. | 219/677 |
| 5,461,215 | A | | 10/1995 | Haldeman | 219/677 |
| 5,504,309 | A | | 4/1996 | Geissler | 219/663 |
| 5,708,253 | A | | 1/1998 | Bloch et al. | 219/130.01 |
| 6,043,471 | A | | 3/2000 | Wiseman et al. | 219/662 |
| 6,124,581 | A | | 9/2000 | Ulrich | 219/665 |
| 6,229,126 | B1 | | 5/2001 | Ulrich et al. | 219/635 |
| 6,265,701 | B1 | | 7/2001 | Bickel et al. | 219/617 |
| 6,316,755 | B1 | | 11/2001 | Ulrich | 219/665 |
| 6,346,690 | B1 | | 2/2002 | Ulrich et al. | 219/635 |

* cited by examiner

METHOD AND APPARATUS FOR DELIVERY OF INDUCTION HEATING TO A WORKPIECE

FIELD OF THE INVENTION

The present invention relates generally to induction heating, and particularly to a method and apparatus for inductively heating a workpiece using a flexible fluid-cooled induction heating cable.

BACKGROUND OF THE INVENTION

Resistive heating is a method of heating a workpiece by flowing electrical current through a resistive heating element. The temperature of the resistive heating element rises due to the flow of electric current through the resistive heating element. Heat is transferred from the resistive heating element to the workpiece by a method of heat transfer, such as thermal conduction. By contrast, induction heating is a method of heating a workpiece by using a magnetic field to induce electric currents in the workpiece. The electric currents in the workpiece cause the temperature of the workpiece to rise.

Induction heating involves applying an AC electric signal to a heating loop or coil placed near a specific location on or around an object, such as a metal, to be heated. The varying or alternating current in the loop creates a varying magnetic flux. Electrical currents are induced in the object by the magnetic flux. The object is heated by the flow of electricity induced in the object by the alternating magnetic field. Induction heating may be used for many different purposes, such as pre-heating a metal before welding, post-heating a weld joint, stress relieving a weld joint, annealing, surface hardening, etc.

Electrical conductors within an induction heating cable may serve as the loop or coil to produce the magnetic field. A source of electrical power is coupled to the induction heating cable to produce the magnetic field. However, in contrast to a resistive heating element, it is not desirable to heat the induction heating cable with the flow of electricity through the induction heating cable. Additionally, the high temperatures that a workpiece may experience during induction heating could damage or destroy an induction heating cable. Consequently, fluid-cooled induction heating cables have been developed to remove heat from the induction heating cable. Cooling units are used to pump cooling fluid through the induction heating cable to remove heat.

Current induction heating cables utilize a single integral connector located at each end of the induction heating cable to both fluidicly and electrically couple the induction heating cable to a coolant source and a current source. Additionally, the single connector is threaded to a corresponding connector to complete the electrical and fluidic coupling. However, the single integral connector design is complicated and difficult to manufacture. Additionally, securing each connector to an opposing connector is time consuming and requires tools to complete.

There is a need therefore for a fluid-cooled induction heating cable that avoids the problems associated with an integral electric and fluidic connector. Specifically, there is a need for a fluid-cooled induction heating cable that physically separates the portions of the induction heating cable that are used to electrically couple the induction heating cable to a source of electrical current from those portions of the induction heating cable that are used to fluidicly couple the induction heating cable to a source of cooling fluid.

Additionally, there is a need for a connector assembly for a fluid-cooled induction heating cable that is easy to assemble and which can be quickly connected and disconnected without the use of tools.

SUMMARY OF THE INVENTION

The present technique provides novel inductive heating components, systems, and methods designed to respond to such needs. According to one aspect of the present technique, an induction heating system is provided. The induction heating system provides a power source and a fluid cooling unit that is operable to provide a flow of cooling fluid. The system also comprises a flexible fluid-cooled induction heating cable that is operable to be electrically coupled to the power source and fluidicly coupled to the fluid cooling unit. The flexible fluid-cooled induction heating cable has a litz wire disposed within a hollow interior of the fluid-cooled induction heating cable. The litz wire is electrically coupled to a plurality of electrical connectors. Each electrical connector is adapted to matingly engage a corresponding electrical connector that is electrically coupled to the power source. The flexible fluid-cooled induction cable also has a plurality of fluid connectors. The fluid connectors are fluidicly coupled to the hollow interior of the fluid-cooled induction heating cable. Each fluid connector is adapted to matingly engage a corresponding fluid connector that is fluidicly coupled to the fluid cooling unit. Each fluid connector also is separate from each electrical connector.

In another arrangement, an induction heating system is provided that comprises a power source, a cooling unit operable to remove heat from a cooling fluid and a flexible induction heating cable. The induction heating cable has an electrical conductor disposed within a hollow interior of the induction heating cable. The induction heating cable has a first electrical connector that is electrically coupled to the electrical conductor. The first electrical connector is adapted for locking engagement with a second electrical connector that is electrically coupled to the power source. The induction heating cable also comprises a first quick-disconnect fluid connector that is fluidicly coupled to the hollow interior of the induction heating cable.

In yet another arrangement, an induction heating system is provided that comprises a power source, a cooling unit, a flexible fluid-cooled induction heating cable, an extension cable, and a first fluid hose. The cooling unit is operable to circulate cooling fluid through the induction heating system. The flexible fluid-cooled induction heating cable has an electrical conductor that is disposed within a hollow interior of the induction heating cable. The flexible induction heating cable also has a first electrical connector that is electrically coupled to the electrical conductor. The flexible fluid-cooled induction heating cable also has a first fluid connector fluidicly coupled to the hollow interior of the flexible fluid-cooled induction heating cable. The extension cable is operable to convey cooling fluid and conduct electricity to the fluid-cooled induction heating cable. The extension cable has a second fluid connector. The first fluid hose is adapted to fluidicly couple the first fluid connector to the second fluid connector.

According to another aspect of the present technique, a fluid-cooled induction heating cable is provided. The fluid-cooled induction heating cable is flexible. The fluid-cooled induction heating cable has a litz wire disposed within a hollow interior of the fluid-cooled induction heating cable. The cable also has a first and a second electrical connector.

Each of the electrical connectors is electrically coupled to the litz wire. The cable also has a first and a second fluid connector. Each fluid connector is separate from each electrical connector and fluidicly coupled to the hollow interior of the fluid-cooled induction heating cable.

In another implementation, the induction heating cable has an electrical conductor disposed within a hollow interior of the induction heating cable. The heating cable also has a first electrical connector that is electrically coupled to the electrical conductor. The first electrical connector is adapted for locking engagement with a second electrical connector that is electrically coupled to the power source. The heating cable also has a first quick-disconnect fluid connector that is fluidicly coupled to the hollow interior of the induction heating cable to enable cooling fluid to flow through the hollow interior of the induction heating cable. The induction heating cable is flexible so as to enable the induction heating cable to be wrapped around a pipe.

The extension cable may be formed as an extension cable having a litz wire disposed within a hollow interior of the extension. The extension cable also has a first electrical connector that is electrically coupled to the litz wire. The first electrical connected is adapted to matingly engage a second electrical connector on the fluid-cooled induction heating cable. The extension also has a first fluid connector fluidicly coupled to the hollow interior of the extension. The first fluid connector is adapted to be fluidicly coupled by a jumper hose to a second fluid connector on the fluid-cooled induction heating cable.

An insulation blanket, comprising a mat of silica fiber insulation within a woven silica blanket also is provided. The insulation blanket is adapted for use with a workpiece of a specific size and shape.

The present technique also provides a method of inductively heating a workpiece is provided. The method comprises placing a temperature feedback device on the workpiece and disposing an insulation blanket around a portion of the workpiece to be heated. The method also comprises routing a flexible fluid-cooled induction heating cable over the insulation blanket around the portion of the workpiece to be heated. The method also comprises connecting electrical connectors located at opposite ends of the flexible fluid-cooled induction heating cable to opposing electrical connectors electrically coupleable to an electrical power source. The method also comprises coupling fluid connectors located apart from each electrical connector on the flexible fluid-cooled induction heating cable to fluid hoses. Each fluid connector is coupled to each fluid hose separately from each electrical connector being connected to an opposing electrical connector.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
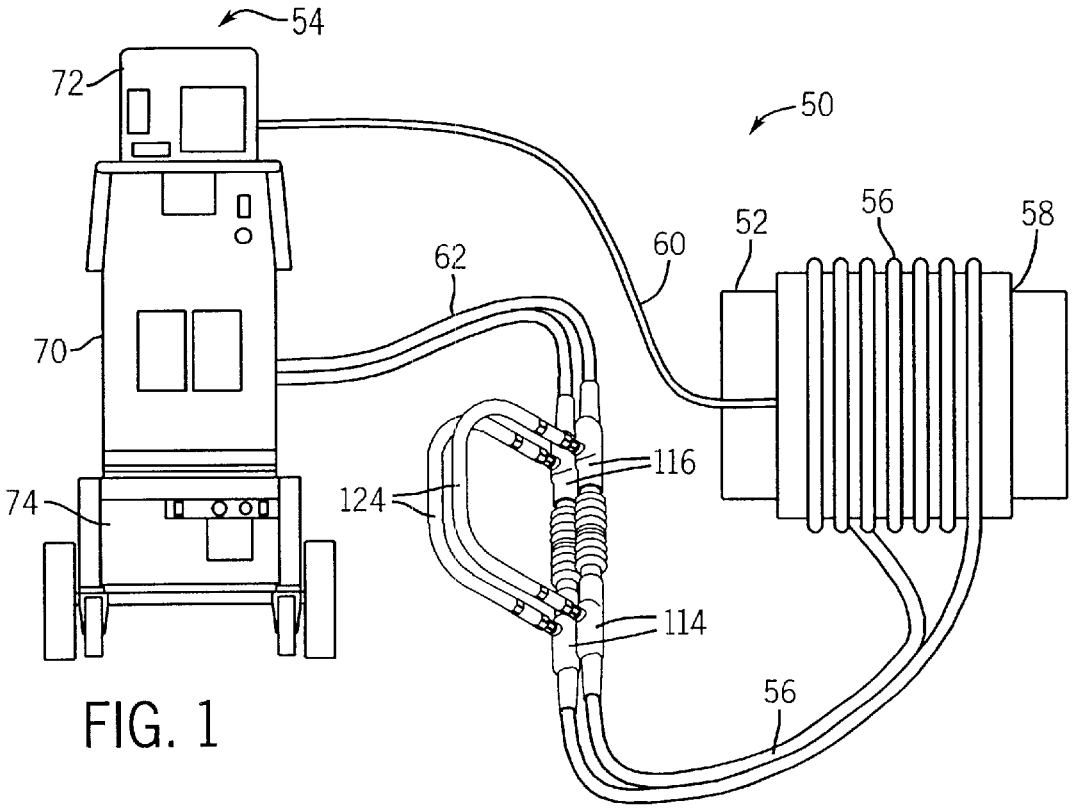
FIG. 1 is an induction heating system, according to an exemplary embodiment of the present technique.

Referring generally to FIGS. 1–5, an induction heating system 50 for applying heat to a workpiece 52 is illustrated. In the illustrated embodiment, the workpiece 52 is a circular pipe. As best illustrated in FIG. 1, the induction heating system 50 comprises a power system 54, a flexible fluid-cooled induction heating cable 56, an insulation blanket 58, at least one temperature feedback device 60, and an extension cable 62. The extension cable 62 is used to extend the effective distance of the fluid-cooled induction heating cable 56 from the power system 54. The power system 54 produces a flow of AC current through the extension cable 62 and fluid-cooled induction heating cable 56. Additionally, the power system provides a flow of cooling fluid through the extension cable 62 and fluid-cooled induction heating cable 56. In FIG. 1, the fluid-cooled induction heating cable 56 has been wrapped around the workpiece 52 several times to form a series of loops.

Figure 2:
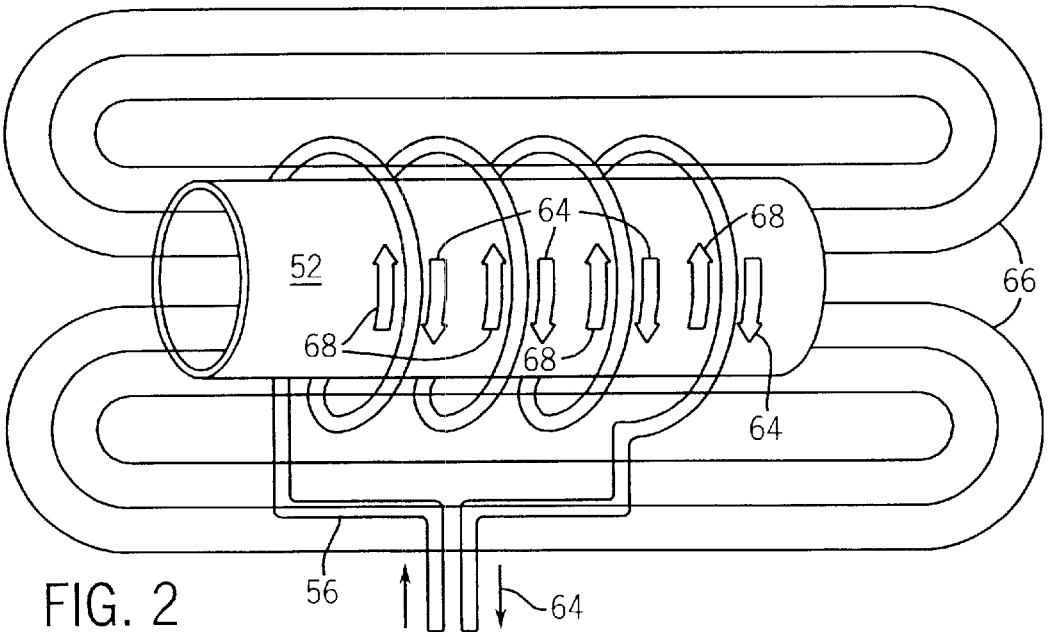
FIG. 2 is a diagram of the process of inducing heat in a workpiece using an induction heating system, according to an exemplary embodiment of the present technique.

As best illustrated in FIG. 2, the AC current 64 flowing through the fluid-cooled induction heating cable 56 produces a magnetic field 66. The magnetic field 66, in turn, induces a flow of current 68 in the workpiece 52. The induced current 68 produces heat in the workpiece 52. Referring again to FIG. 1, the insulation blanket 58 forms a barrier to reduce the loss of heat from the workpiece 52 and to protect the fluid-cooled induction heating cable 56 from heat damage. The fluid flowing through the fluid-cooled induction heating cable 56 also acts to protect the fluid-cooled induction heating cable 56 from heat damage due to the temperature of the workpiece 52 and electrical current flowing through the fluid-cooled induction heating cable. The temperature feedback device 60 provides the power system 54 with temperature information from the workpiece 52.

Referring again to FIG. 1, in the illustrated embodiment, the power system 54 comprises a power source 70, a controller 72, and a cooling unit 74. The power source 70 produces the AC current that flows through the fluid-cooled induction heating cable 56. The controller 72 is programmable and is operable to control the operation of the power source 70. In the illustrated embodiment, the controller 72 controls the operation of the power source 70 in response to programming instructions and the workpiece temperature information received from the temperature feedback device 60. The cooling unit 74 is operable to provide a flow of cooling fluid through the fluid-cooled induction heating cable 56 to remove heat from the fluid-cooled induction heating cable 56.

Figure 3:
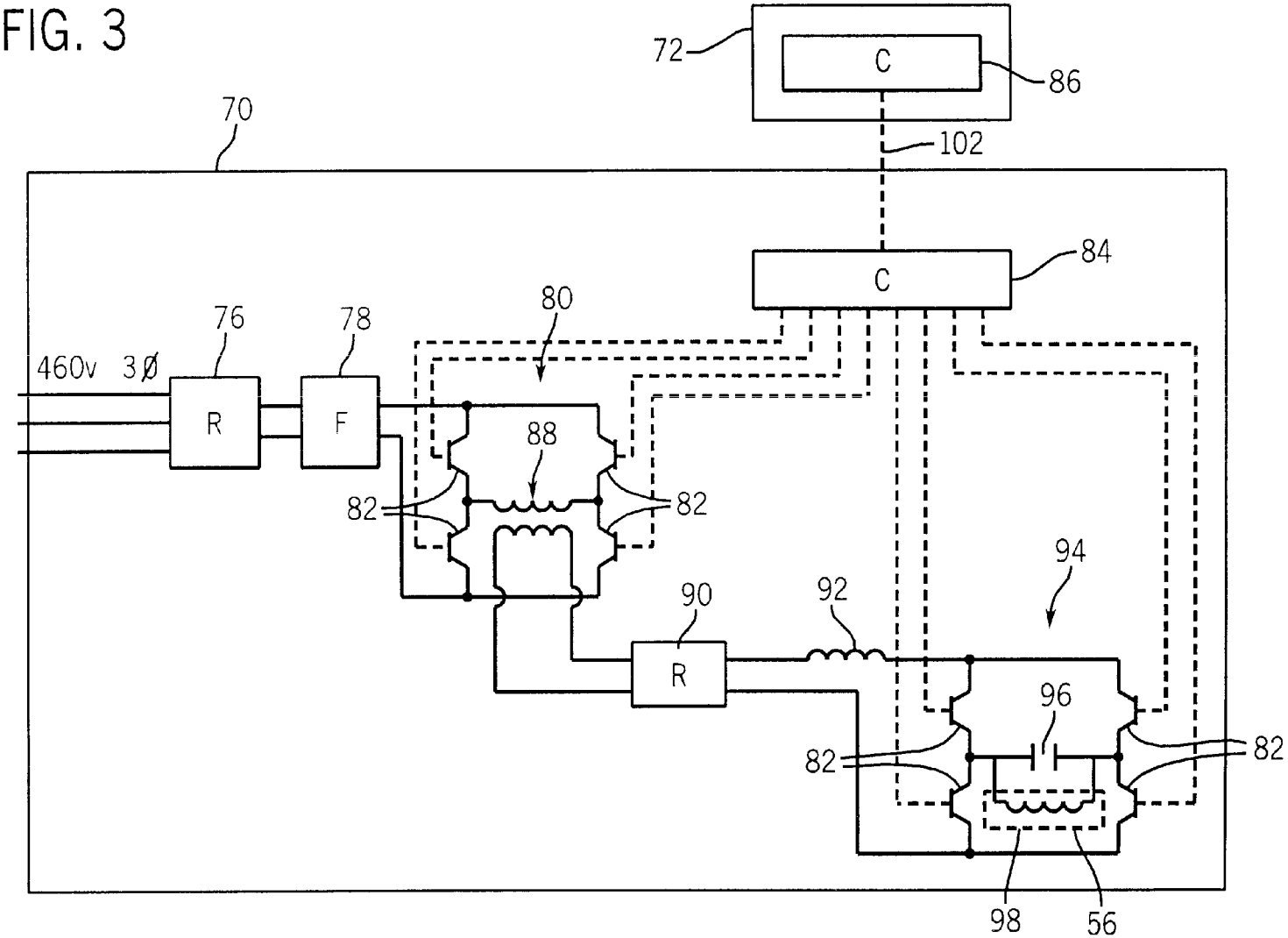
FIG. 3 is an electrical schematic diagram of an induction heating system, according to an exemplary embodiment of the present technique.

Referring generally to FIG. 3, an electrical schematic of a portion of the system 50 is illustrated. In the illustrated embodiment, 460 Volt, 3-phase AC input power is coupled to the power source 70. A rectifier 76 is used to convert the AC power into DC power. A filter 78 is used to condition the rectified DC power signals. A first inverter circuit 80 is used to invert the DC power into desired AC output power. In the illustrated embodiment, the first inverter circuit 80 comprises a plurality of electronic switches 82, such as IGBTs. Additionally, in the illustrated embodiment, a controller board 84 housed within the power source 70 controls the electronic switches 82. A controller circuit 86 within the controller 72 in turn, controls the controller board 84.

A step-down transformer 88 is used to couple the AC output from the first inverter circuit 80 to a second rectifier circuit 90, where the AC is converted again to DC. In the illustrated embodiment, the DC output from the second rectifier 90 is, approximately, 600 Volts and 50 Amps. An inductor 92 is used to smooth the rectified DC output from the second rectifier 90. The output of the second rectifier 90 is coupled to a second inverter circuit 94. The second inverter circuit 94 steers the DC output current into high-frequency AC signals. A capacitor 96 is coupled in parallel with the fluid-cooled induction heating cable 56 across the output of the second inverter circuit 94. The fluid-cooled induction heating cable 56, represented schematically as an inductor 98, and capacitor 96 form a resonant tank circuit. The capacitance and inductance of the resonant tank circuit establishes the frequency of the AC current flowing through the fluid-cooled induction heating cable 56. The inductance of the fluid-cooled induction heating cable 56 is influenced by the number of turns of the heating cable 56 around the workpiece 52. The current flowing through the fluid-cooled induction heating cable 56 produces a magnetic field that induces current flow, and thus heat, in the workpiece 52.

Figure 4:
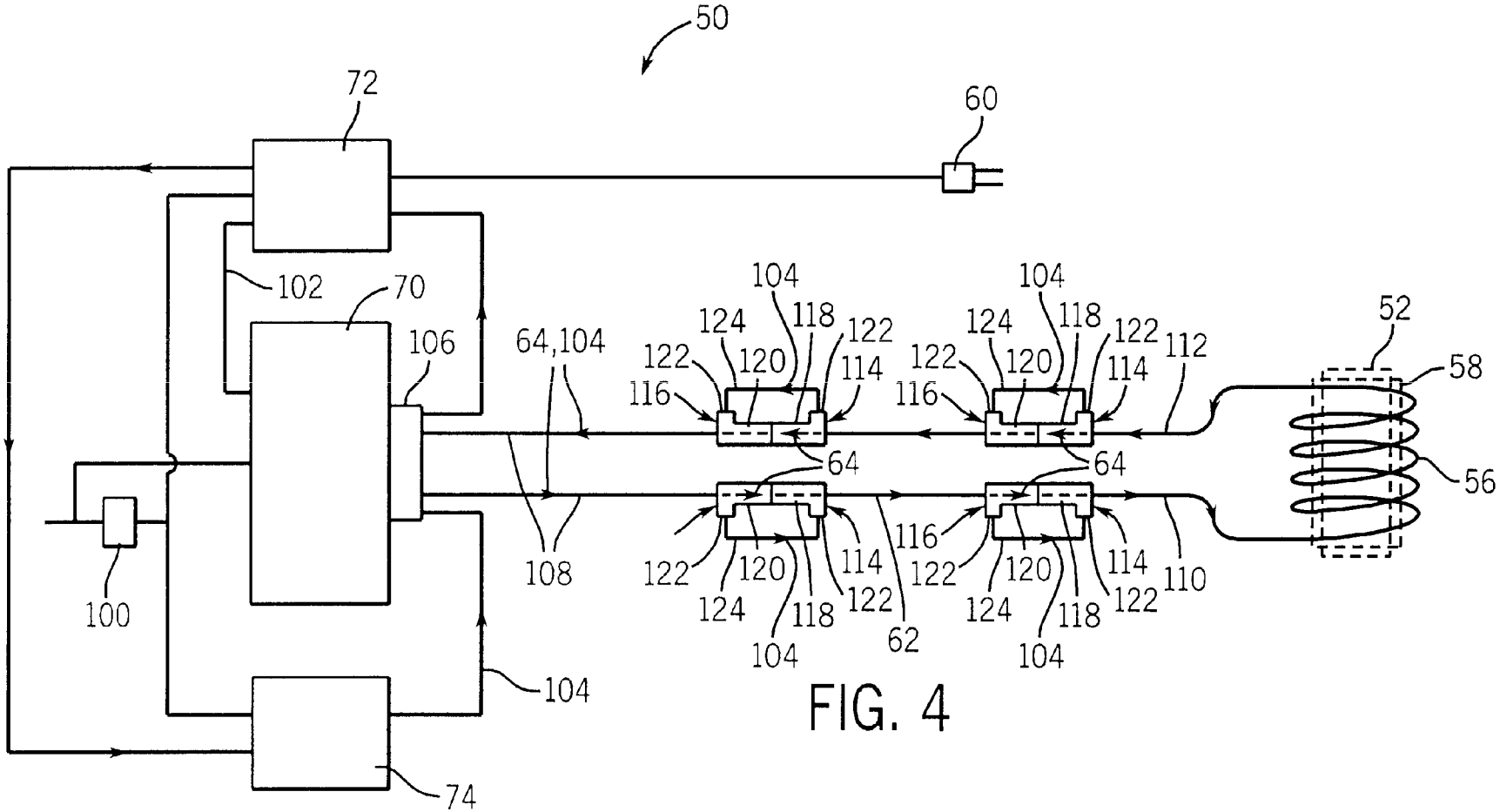
FIG. 4 is a schematic diagram of a system for inductively heating a workpiece, according to an exemplary embodiment of the present technique.

Referring generally to FIG. 4, an electrical and fluid schematic of the induction heating system 50 is illustrated. In the illustrated embodiment, 460 Volt, 3-phase AC input power is supplied to the power source 70 and to a step-down transformer 100. In the illustrated embodiment, the step-down transformer 100 produces a 115 Volt output applied to the fluid cooling unit 74 and to the controller 72. The step-down transformer 100 may be housed separately or within one of the other components of the system 50, such as the fluid cooling unit 74. A connector cable 102 is used to electrically couple the controller 72 and the power source 70. As discussed above, the power source 70 provides a high-frequency AC power output, such as radio frequency AC signals, to the heating cable 56.

In the illustrated embodiment, cooling fluid 104 from the cooling unit 74 flows to an output block 106. The cooling fluid 104 may be water, anti-freeze, etc. Additionally, the cooling fluid 104 may be provided with an anti-fungal or anti-bacterial solution. The cooling fluid 104 flows from the cooling unit 74 to the output block 106. Electrical current 64 from the power source 70 also is coupled to the output block 106. An output cable 108 is connected to the output block 106. In the illustrated embodiment, the output cable 108 couples cooling fluid and electrical current to the extension cable 62. The extension cable 62, in turn, couples cooling fluid 104 and electrical current 64 to the fluid-cooled induction heating cable 56.

In the illustrated embodiment, cooling fluid 104 flows from the output block 106 to the fluid-cooled induction heating cable 56 along a supply path 110 through the output cable 108 and the extension cable 62. The cooling fluid 104 returns to the output block 106 from the fluid-cooled induction heating cable 56 along a return path 112 through the extension cable 62 and the output cable 108. AC electric current 64 also flows along the supply and return paths. The AC electric current 64 produces a magnetic field that induces current, and thus heat, in the workpiece 52. Heat in the heating cable 56, produced either from the workpiece 52 or by the AC electrical current flowing through conductors in the heating cable 56, is carried away from the heating cable 56 by the cooling fluid 104. Additionally, the insulation blanket 58 forms a barrier to reduce the transfer of heat from the workpiece 52 to the heating cable 56.

Referring generally to FIGS. 1 and 4, in the illustrated embodiment, the fluid-cooled induction heating cable 56 has a first connector assembly 114. The extension cable 62 is illustrated as having a pair of first connector assemblies 114 and a pair of second connector assemblies 116 adapted for mating engagement with the first connector assemblies 114. However, a connector assembly that is adapted for mating engagment with an identical connector assembly may also be used. In the illustrated embodiment, each connector assembly separately couples electricity and cooling fluid. The connector assemblies are electrically coupled by connecting a first electrical connector 118 in the first connector assembly 114 with a second electrical connector 120 in the second connector assembly 116. Each of the connector assemblies also has a hydraulic fitting 122. The connector assemblies are fluidicly coupled by routing a jumper 124 from the hydraulic fitting 122 in the first connector assembly 114 to the hydraulic fitting 122 in the second connector assembly 116. Electrical current 64 flows through the electrical connectors 118 and 120 and fluid 104 flows through the hydraulic fittings 122 and jumper 124.

In the illustrated embodiment, cooling fluid 104 from the heating cable 56 is then coupled to the controller 72. Cooling fluid flows from the controller 72 back to the cooling unit 74. The cooling unit 74 removes heat in the cooling fluid 104 from the heating cable 56. The cooled cooling fluid 104 is then supplied again to the heating cable 56.

Figure 5:
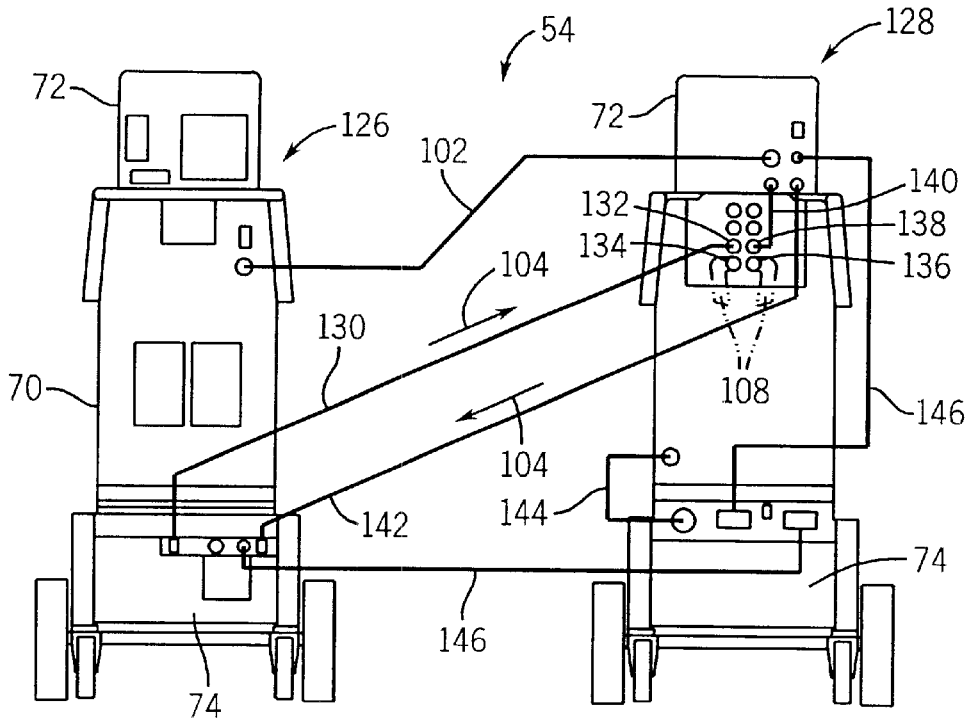
FIG. 5 is an elevational drawing illustrating the front and the rear of an induction heating system, according to an exemplary embodiment of the present technique.

Referring generally to FIG. 5, front and rear views of a single power system 54 are illustrated. In the illustrated embodiment, the front side 126 of the power system 54 is shown on the left and the rear side 128 of the power system 54 is shown on the right. A first hose 130 is used to route fluid 104 from the front of the cooler 74 to a first terminal 132 of the output block 106 on the rear of the power source 70. The first terminal 132 is fluidicly coupled to a second terminal 134 of the output block 106. The output cable 108 is connected to the second terminal 134 and a third terminal 136. The second and third terminals are operable to couple both cooling fluid and electric current to the output cable 108. Supply fluid flows to the heating cable 56 through the second terminal 134 and returns from the heating cable 56 through the third terminal 136. The third terminal 136 is, in turn, fluidicly coupled to a fourth terminal 138. A second hose 140 is connected between the fourth terminal 138 and the controller 72. A third hose 142 is connected between the controller 72 and the cooling unit 74 to return the cooling fluid to the cooling unit 74, so that heat may be removed. An electrical jumper cable 144 is used to route 460 Volt, 3-phase power to the power source 70. Various electrical cables 146 are provided to couple 115 Volt power from the step-down transformer 100 to the controller 72 and the cooling unit 74.

Figure 6:
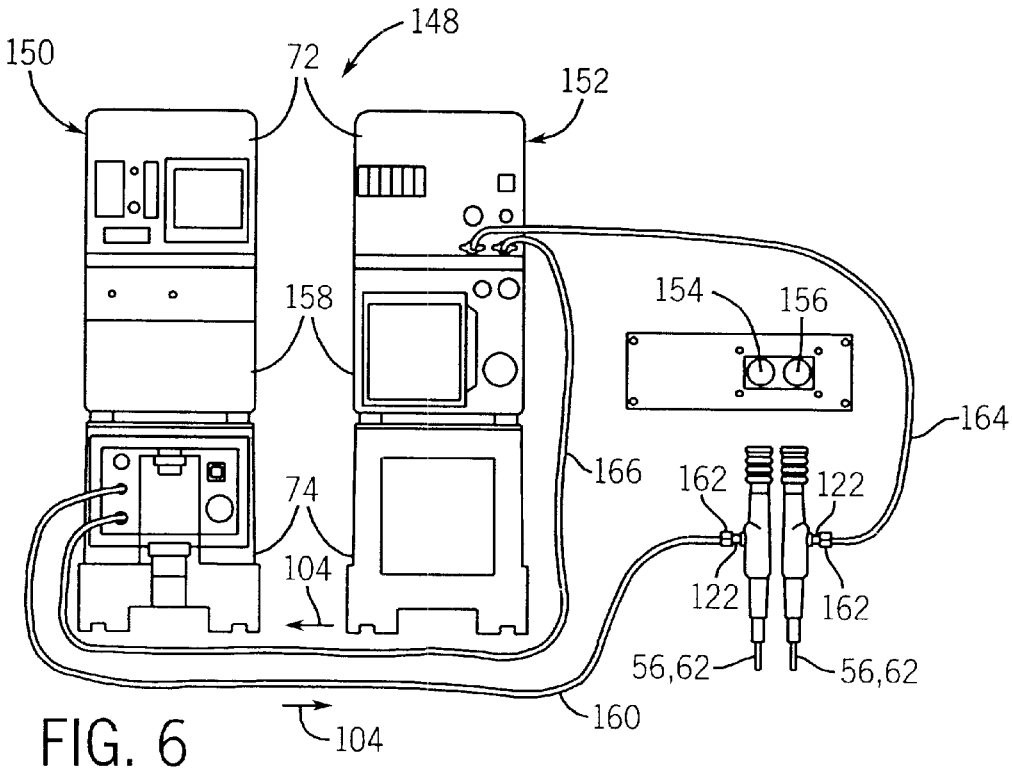
FIG. 6 is an elevational drawing illustrating the front and the rear of an induction heating system, according to an alternative embodiment of the present technique.

Referring generally to FIG. 6, front and rear views of a single alternative power system 148 are illustrated. In the illustrated embodiment, the front side 150 of the alternative power system 148 is shown on the left, and the rear side 152 of the alternative power system 148 is shown on the right. In the illustrated embodiment, cooling fluid is not routed through an output block in the power source. The heating cable 56 or an extension cable 62 is connected to a first output connector 154 and a second output connector 156 of an alternative embodiment of a power source 158. A first hose 160 is used to couple cooling fluid 104 from the cooling unit 74 to a first or second connector assembly on the heating cable 56 or extension cable 62. The first hose is adapted with a hydraulic fitting 162 configured for mating engagement with a hydraulic fitting 122 on the first or second connector assembly. A second hose 164 with a hydraulic fitting 162 is used to couple the controller 72 to a first or second connector assembly on the heating cable 56 or extension cable 62. A third hose 166 is routed between the controller 72 and the cooling unit 74 to complete the fluid flow path.

Figure 7:
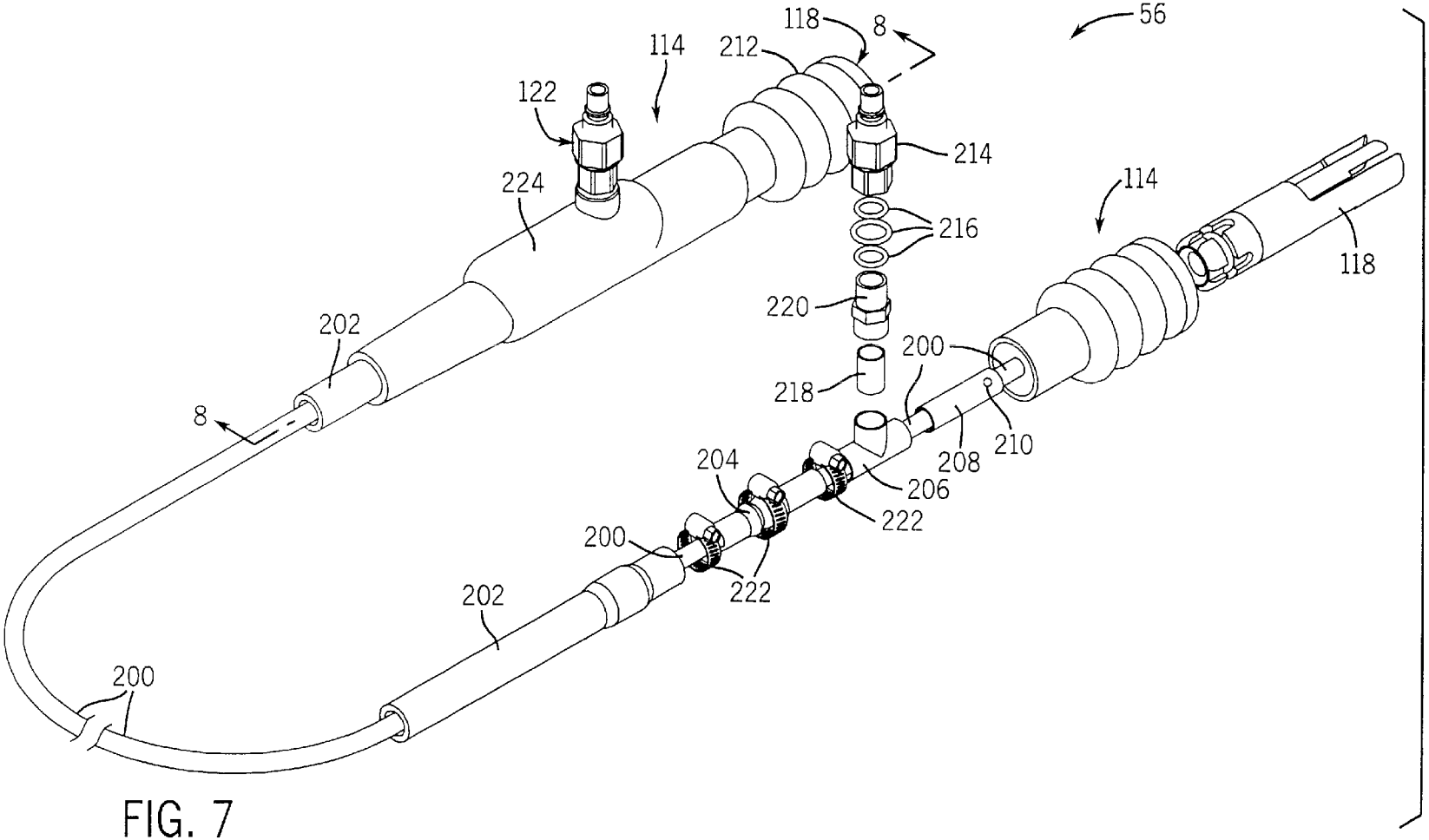
FIG. 7 is a partial exploded view of a flexible fluid-cooled induction heating cable, according to an exemplary embodiment of the present technique.

Referring generally to FIG. 7, the AC electric current is typically produced at a high frequency, such as a radio frequency. At high frequencies, the current carried by a conductor is not uniformly distributed over the cross-sectional area of the conductor, as is the case with DC current. This phenomenon, referred to as the "skin effect", is a result of magnetic flux lines that circle part, but not all, of the conductor. At radio frequencies, approximately 90 percent of the current is carried within two skin depths of the outer surface of a conductor. For example, the skin depth of copper is about 0.0116 inches at 50 KHz, and decreases with increasing frequency. The reduction in the effective area of conduction caused by the skin effect increases the effective electrical resistance of the conductor.

In the illustrated embodiment, the heating cable 56 utilizes a litz wire 200 to carry the AC current 64 that produces the magnetic field. The litz wire 200 is used to minimize the effective electrical resistance of the fluid-cooled induction heating cable 56 at high frequencies. A litz wire 200 utilizes a large number of strands of fine wire that are insulated from each other except at the ends where the various wires are connected in parallel. The individual strands are woven in such a way that each strand occupies all possible radial positions to the same extent. The litz wire 200 is housed within a hose 202. In the illustrated embodiment, the hose 202 is a silicon hose. However, other flexible hose material may be used. Cooling fluid flows through the hose 202 around the litz wire 200.

Figure 8:
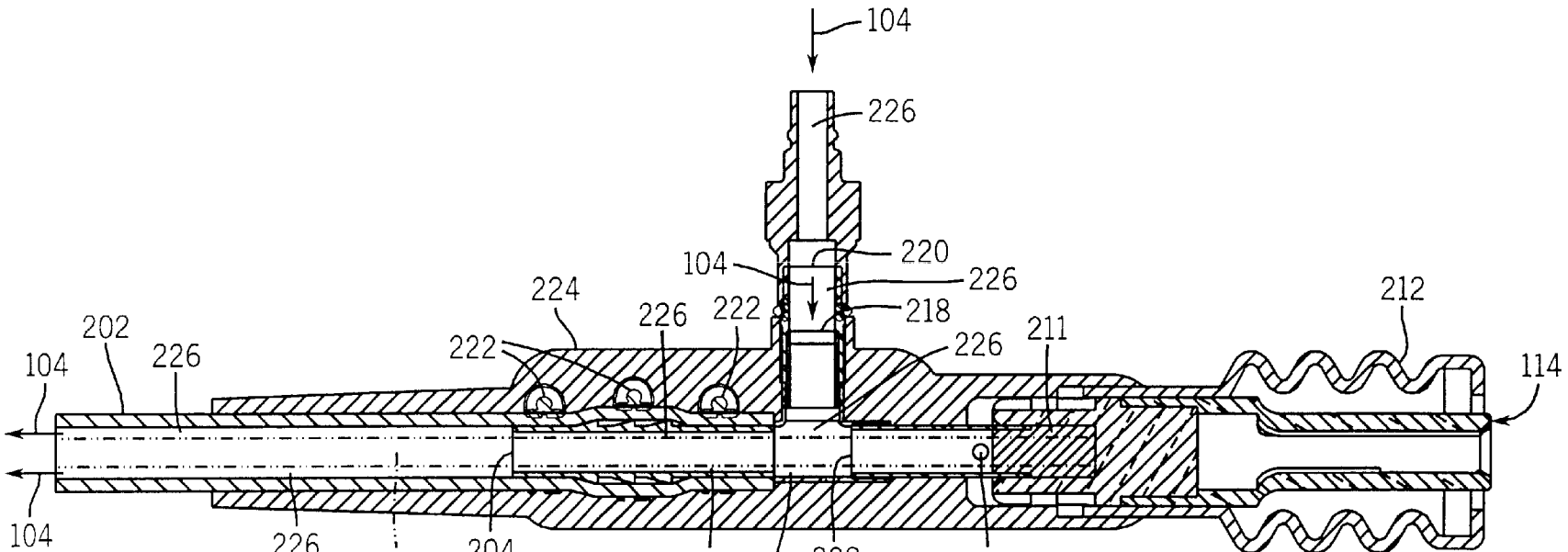
FIG. 8 is a cross-sectional view of the flexible fluid-cooled induction heating cable of FIG. 7, taken generally along line 7—7 of FIG. 7.

Each first connector assembly 114 comprises a barbed tubing piece 204, a tee section 206, and a piece of straight tubing 208. As best illustrated in FIG. 8, the litz wire 200 extends through the barbed tubing piece 204, the tee section 206, and the straight tubing 208 in each first connector assembly 114. Each end of the litz wire 200 is soldered to the first and second electrical connectors, respectively. A weep hole 210 is provided to indicate to the solderer when a sufficient amount of solder 211 has been applied. Solder 211 will flow out of the interior of the straight tubing piece 208 through the weep hole 210 when sufficient solder 211 has been applied to the solder joint. A flexible bellows cover 212 is provided to cover and electrically insulate the first and second electrical connectors, respectively.

Referring generally to FIGS. 7 and 8, in the illustrated embodiment, each hydraulic fitting 122 comprises a quick-disconnect nipple 214, at least one O-ring or similar seal 216, a piece of straight tubing 218, and an adapter 220. The quick-disconnect nipple 214 enables fluid connections to be made quickly without the use of tools. Additionally, the quick-disconnect nipple 214 and the adapter 220 are configured to enable the quick-disconnect nipple 214 to be easily removed from the adapter 220 if the disconnect nipple 214 becomes damaged or worn. The O-rings 216 are used to encase exposed areas of adapter 220, which is electrically coupled to the first electrical connector 118. The hose 202 is placed over the barbed section 204. Hose clamps 222 are used to further secure the hose 202 to the barbed section 204. Once assembled, each connector assembly is covered by a polymeric material 224 formed over the connector assembly in a molding process. Cooling fluid 104 flows through each connector assembly in a coolant path 226 formed between the litz wire 200 and the hose 202, the litz wire 200 and the barbed piece 204, the litz wire 200 and the tee section 206, and through the hollow interior of the straight piece 218, the adapter 220, and the quick-disconnect nipple 214.

Figure 9:
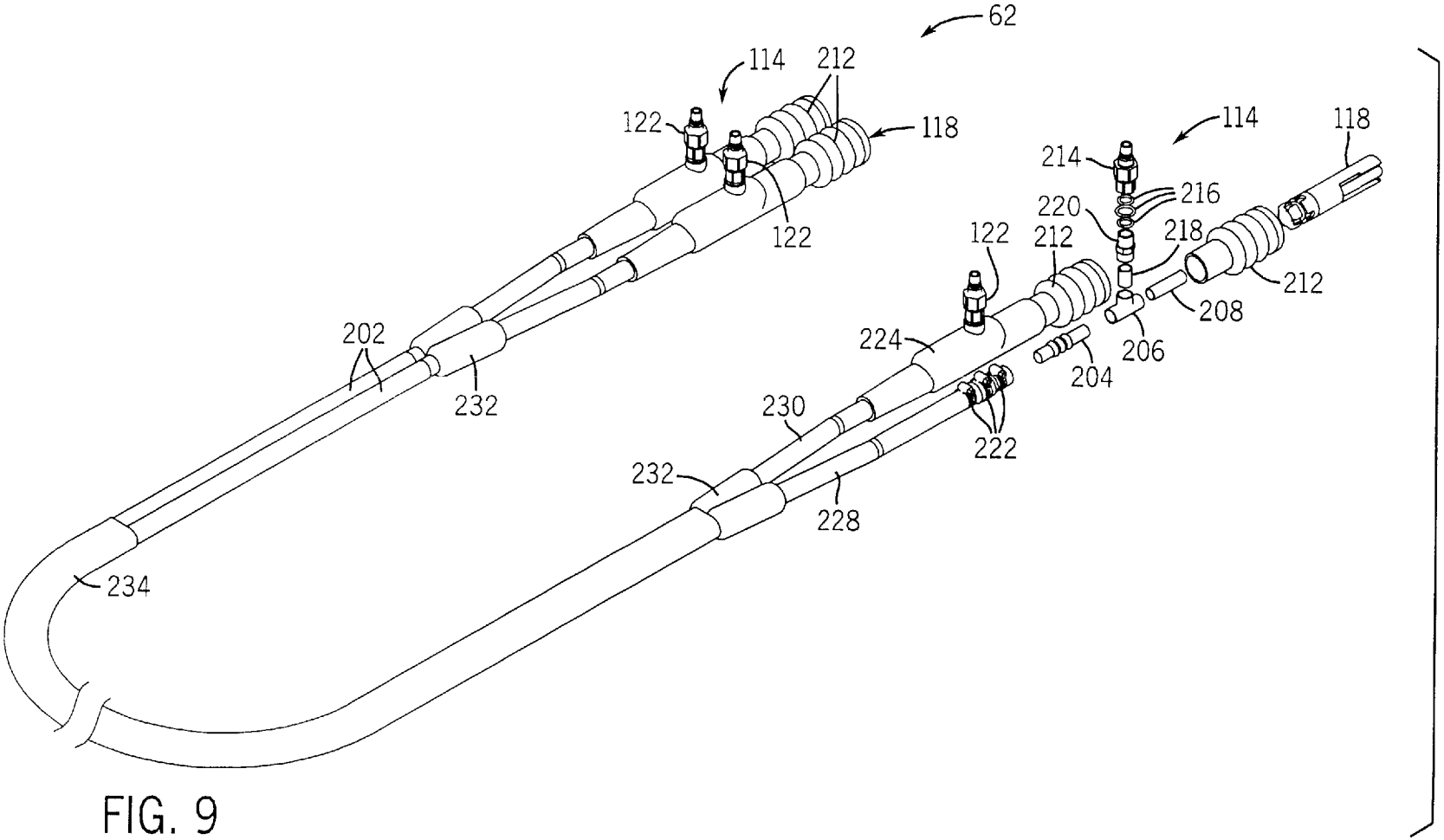
FIG. 9 is a partial exploded view of an extension cable for the flexible fluid-cooled induction heating cable, according to an exemplary embodiment of the present technique.
Figure 10:
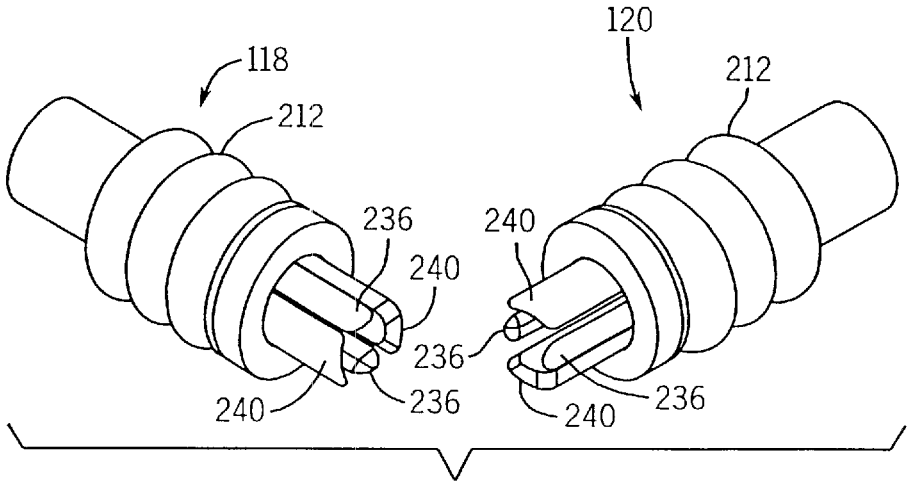
FIG. 10 is a perspective view of first and second electrical connectors, according to an exemplary embodiment of the present technique.

Referring generally to FIG. 9, the extension cable 62 is used to couple electrical current and cooling fluid to and from the heating cable 56. The extension cable 62 comprises a first extension 228 and a second extension 230. One extension is used to form part of the supply path 110 of cooling fluid 104 and electrical current 64 to the flexible fluid-cooled induction heating cable 56, and the other extension is used to form part of the return path 112. In the illustrated embodiment, either extension may be used in the supply and return paths. In the illustrated embodiment, the first and second extensions are secured together along a portion of their lengths. In this embodiment, a pair of molded pieces 232 and a cover 234 are used to secure the first and second extensions together.

In the illustrated embodiment, one end of the extension cable 62 is illustrated as having a pair of first connector assemblies 114 at one end and a pair of second connector assemblies 116 at the opposite end. However, this arrangement may be altered based on the configuration of the heating cable 56 and/or the connectors on the power source.

As with the flexible fluid-cooled induction heating cable 56, a litz wire 200 (not shown) is used to electrically couple each first electrical connector 118 to its corresponding second electrical connector 120. Also, each first and second connector assembly of the extension cable 62 comprises a hydraulic fitting 122 to enable a jumper 124 to be quickly connected to, or quickly disconnected from, the connector assembly.

Referring generally to FIGS. 9–13, the first and second connector assemblies are adapted to enable the fluid-cooled induction heating cable 56 and the extension cable 62 to be coupled both electrically and fluidicly. Additionally, the first and second connector assemblies are adapted to enable the fluid-cooled induction heating cable 56 and extension cable 62 to be quickly connected and disconnected. Furthermore, in the illustrated embodiment, the first and second connector assemblies are configured with a twist-lock feature to enable the first and second connector assemblies to be secured together.

In the illustrated embodiment, the first electrical connector 118 and the second electrical connector 120 are identical. Each electrical connector comprises a plurality of prong conductors 236 and a plurality of first plate-like conductors 240. The prong In the illustrated embodiment, the plate-like conductors 240 of one electrical connector are adapted to securely engage the plate-like conductors 240 of another electrical connector.

Figure 11:
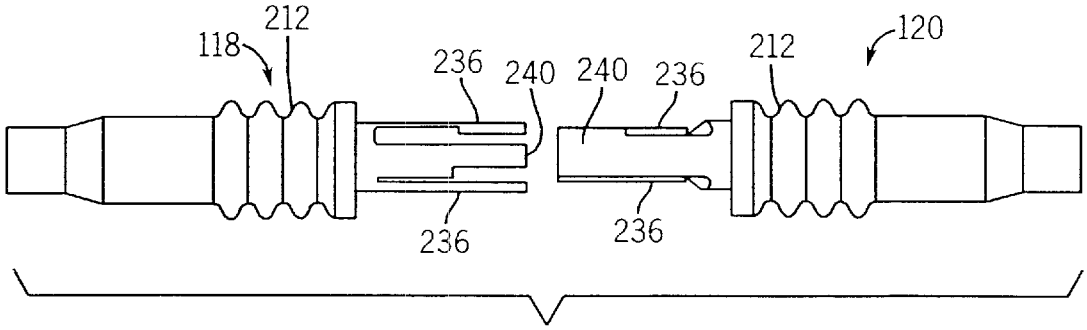
FIG. 11 is a front elevational view illustrating the process of aligning the first and second electrical connectors for connection, according to an exemplary embodiment of the present technique.

Referring generally to FIG. 11, to connect the electrical connectors, the first and second electrical connectors are aligned so that the prong conductors and plate-like conductors are aligned. The first and second electrical connectors are then driven into engagement. The plate-like connectors 240 are driven over and into engagement with the prong conductors 238. The prong and/or the plate-like connectors are adapted so that they are biased into engagement when the first and second connector assemblies are driven into engagement. This arrangement provides a large surface area for electrical contact between the first and second electrical connectors. It has been found that by increasing the area of surface contact between the electrical connectors the unwanted consequences of the skin effect that occurs in conductors at high frequencies can be reduced.

Figure 12:
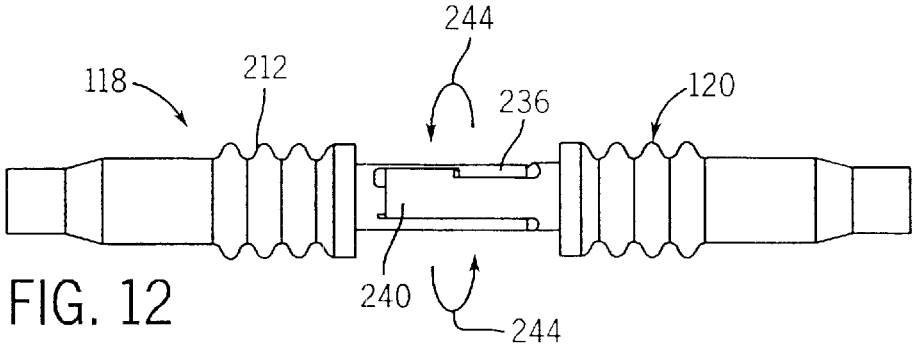
FIG. 12 is a front elevational view illustrating the process of joining and securing the first and second electrical connectors, according to an exemplary embodiment of the present technique.

Referring generally to FIG. 12, once engaged, the first and second electrical connectors are twisted relative to each other, as represented by the arrows 244, to securely engage the first and second plate-like connectors. To disconnect the first and second electrical connectors, the first and second electrical connectors are twisted in a second direction, opposite the first direction, so that the first plate-like connectors 240 and the second plate-like connectors 242 are unsecured. The first and second electrical connectors may then be pulled apart.

Figure 13:
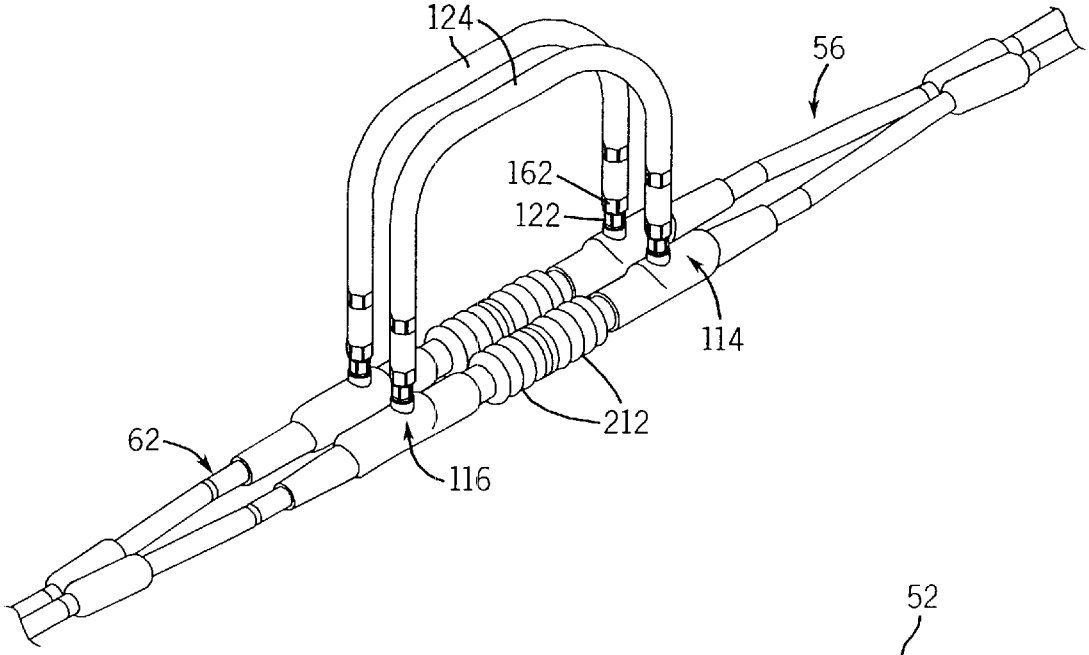
FIG. 13 is a perspective view illustrating the process of connecting the flexible fluid-cooled induction heating cable and the extension for the flexible fluid-cooled induction heating cable, according to an exemplary embodiment of the present technique.

Referring generally to FIG. 13, a pair of jumper hoses 124 are used to fluidicly couple the fluid-cooled induction heating cable 56 and the extension cable 62. The jumper hoses 124 are adapted with quick-disconnect fittings 162 to enable the jumper hoses 124 to be quickly connected to and disconnected from the hydraulic fittings 122 on the first and second connector assemblies. Physically separating the electrical connectors from the fluid connectors simplifies the design and manufacture of the first and second connector assemblies. Additionally, physically separating the electrical connectors from the fluid connectors reduces the potential for electrical shock when connecting and disconnecting the system 50.

Figure 14:
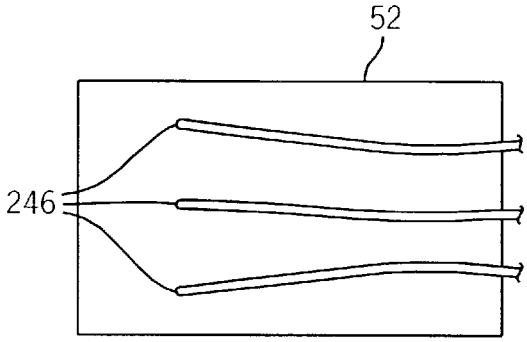
FIG. 14 is a view illustrating the application of thermocouples to a workpiece, according to an exemplary embodiment of the present technique.

Referring generally to FIG. 14, in this embodiment, thermocouple wires 246 are used as the temperature feedback devices 60. A plurality of thermocouple wires 246 may be coupled to the controller 72. In the illustrated embodiment, thermocouple wires 246 are located near the bottom, middle, and top of the workpiece 52. In certain applications, the temperature of the workpiece 52 may vary from top to bottom due to convection heat losses. Therefore, placing thermocouple wires 246 at various locations provides a more accurate indication of the temperature of the workpiece 52. The temperature signal from a thermocouple wire 246 may be used to control the application of heat to the workpiece 52, as well as to provide an indication of the temperature of the workpiece 52. Furthermore, thermocouple wires also may be placed on the inside of the workpiece 52.

Figure 15:
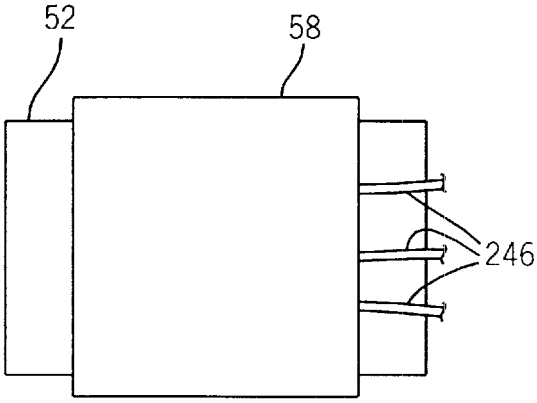
FIG. 15 is a view illustrating the application of a thermal insulation blanket over the workpiece.

Referring generally to FIG. 15, the insulation blanket 58 is placed over the portion of the workpiece 52 to be heated and over any thermocouple wires 246 that may be placed on the exterior of the workpiece 52 over the region to be heated. The insulation blanket 58 is adapted to insulate the workpiece 52 for heating efficiency and to protect the fluid-cooled induction heating cable 56 from high temperatures. Preferably, the insulation blanket 58 is sized for the specific workpiece to be heated so that the thickness of the insulation is consistent around the workpiece. Inconsistencies in the thickness of the insulation blanket 58 around the workpiece could result in variations in temperature around the workpiece. For example, the insulation blanket 58 may be available in a variety of sizes corresponding to specific pipe diameters. Preferably, the pipe diameter is identified and the insulation blanket 58 corresponding to that pipe diameter is selected.

Figure 16:
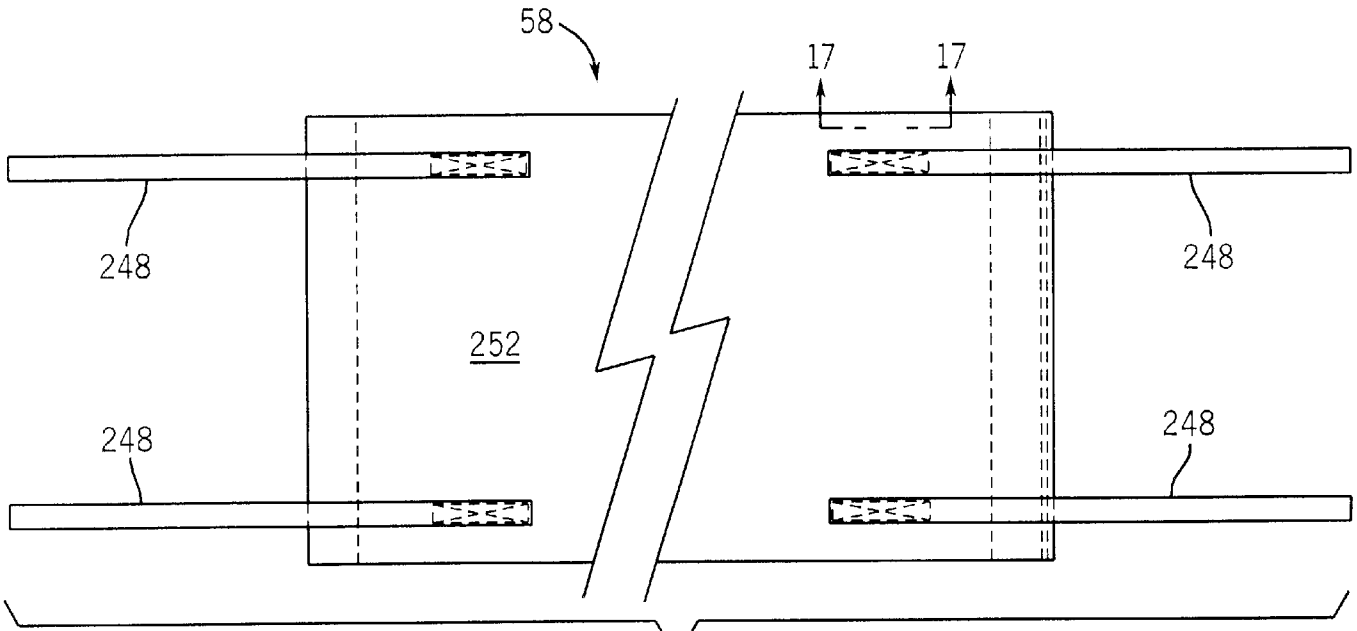
FIG. 16 is an elevational view of an insulation blanket; according to an exemplary embodiment of the present technique.

Referring generally to FIG. 16, in the illustrated embodiment, the insulation blanket 58 has been sized to be wrapped once around a 12-inch diameter pipe with minimal, if any, overlap. Alternatively, the insulation blanket 58 may be adapted to be wrapped more than once around the workpiece with minimal, if any, overlap. In the illustrated embodiment, the insulation blanket has a plurality of high temperature straps 248 that are used to secure the insulation blanket 58 in place around the workpiece 52.

Figure 17:
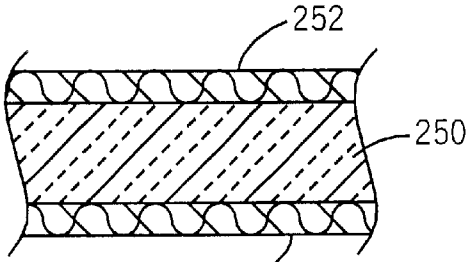
FIG. 17 is a cross-sectional view of a portion of the insulation blanket of FIG. 16, taken generally along line 17—17 of FIG. 16.

As best illustrated in FIG. 17, the insulation blanket 58 comprises an insulation mat 250 sewn into a woven silica blanket 252. In the illustrated embodiment, the insulation mat 250 is made from continuous filament silica fiber. The high temperature straps also are made of woven silica and sewn onto the silica blanket for easy attachment to the workpiece. The silica material has a continuous use temperature rating of over 2000 deg. F. with a melting point of 3000 deg. F. Additionally, the insulation mat 250 and silica blanket 252 markedly reduce the temperature to which the fluid-cooled induction heating cable 56 is exposed. For example, a ½-inch thick insulation blanket 58 exposed, on its hot side, to a workpiece temperature of 1840° F., will have a cold-side temperature of approximately 298° F. after 2 hours, a temperature difference of 1542° F. Furthermore, the insulation mat 250 and silica blanket 252 provide the insulation blanket 58 greater durability, enabling the insulation blanket 58 to be reused several times, e.g., up to 50 times. Additionally, the silica blanket 252 reduces the insulation dust and particulate that is associated with bulk insulation materials.

Figure 18:
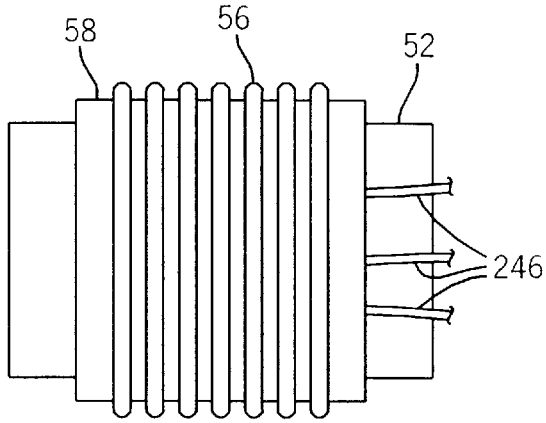
FIG. 18 is a view illustrating the wrapping of a flexible fluid-cooled induction heating cable to a workpiece to form an inductive coil, according to an exemplary embodiment of the present technique.

Referring generally to FIG. 18, the fluid-cooled heating cable 56 is flexible to enable the heating cable 56 to be wrapped around the workpiece 52 to form the coils of an inductor. The insulation blanket 58 and the cooling fluid 104 flowing through the fluid-cooled induction heating cable 56 maintain the heating cable 56 cool to the touch. Thus, if the temperature information from the thermocouple wires 246 indicates that a region of the workpiece 52 is not at the proper temperature, the fluid-cooled heating cable 56 may be moved by hand into a better orientation relative to the workpiece 52.

Figure 19:
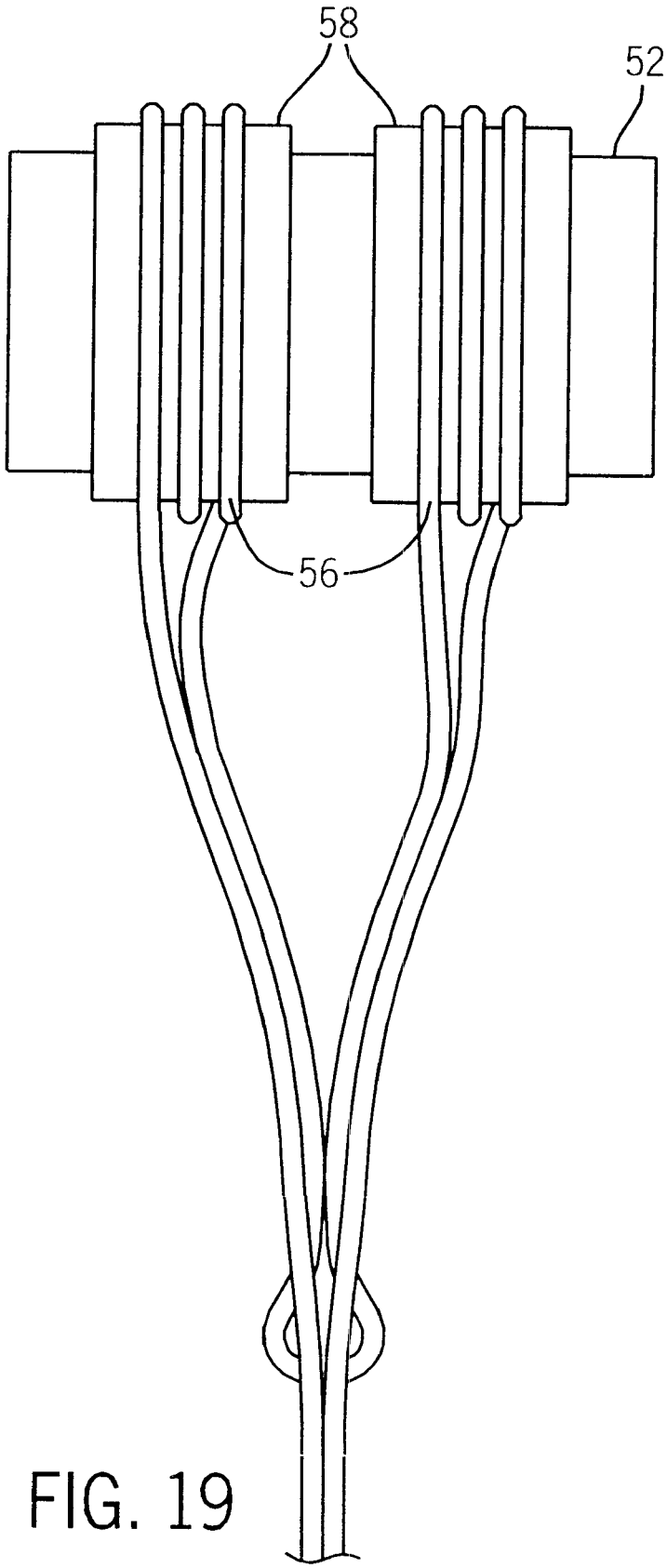
FIG. 19 is a view illustrating the wrapping of a flexible fluid-cooled induction heating cable to a workpiece to enable access to a heated region of the workpiece, according to an alternative embodiment of the present technique.

Referring generally to FIG. 19, alternatively, the heating cable may be wrapped around a first region of the workpiece 52 to form a first set of coils and then routed to a second region of the workpiece 52 to form a second set of coils. This arrangement enables an uncovered third region of the workpiece, between the first and second regions, to be heated, yet still remain accessible.

It will be understood that the foregoing description is of preferred exemplary embodiments of this invention, and that the invention is not limited to the specific forms shown. For example, the various electrical connectors on the power source, fluid-cooled induction heating cable, and extension cable may be oriented in a variety of orientations and configurations. For example, the fluid-cooled induction heating cable may have the same type of electrical connector at each end, or a different type of connector at each end. Similarly, the extension cable may have many different electrical connector configurations. These and other modifications may be made in the design and arrangement of the elements without departing from the scope of the invention as expressed in the appended claims.

What is claimed is:

1. An induction heating system, comprising:

a power source;

a fluid cooling unit operable to provide a flow of cooling fluid; and a flexible fluid-cooled induction heating cable operable to be electrically coupled to the power source and fluidicly coupled to the fluid cooling unit comprising:

a litz wire disposed within a hollow interior of the fluid-cooled induction heating cable;

a plurality of electrical connectors electrically coupled to the litz wire, each electrical connector being adapted to matingly engage a corresponding electrical connector electrically coupled to the power source; and a plurality of fluid connectors fluidicly coupled to the hollow interior of the fluid-cooled induction heating cable, each fluid connector being adapted to matingly engage a corresponding fluid connector fluidicly coupled to the fluid cooling unit, wherein each fluid connector is separate from each electrical connector.

2. The system as recited in claim 1, comprising a hose having a corresponding fluid connector, the hose fluidicly coupling the flexible fluid cooled induction heating cable to the fluid cooling unit.

3. The system as recited in claim 1, comprising an extension cable operable to convey cooling fluid and conduct electric current, the extension cable having a corresponding electrical connector adapted for mating engagement with an electrical connector of the flexible fluid-cooled induction heating cable.

4. The system as recited in claim 3, wherein the extension cable comprises a litz cable electrically coupled to the corresponding electrical connector.

5. The system as recited in claim 3, comprising a coupling hose adapted to fluidicly couple the fluid connector of the flexible fluid-cooled induction heating cable with a fluid connector of the extension cable.

6. The system as recited in claim 1, wherein a fluid connector is adapted to lockingly engage a corresponding fluid connector without using a tool.

7. The system as recited in claim 1, wherein each electrical connector is adapted to lockingly engage a corresponding electrical connector without using a tool.

8. The system as recited in claim 1, wherein each electrical connector comprises a first plurality of electrical conductors adapted to engage a second plurality of electrical conductors in the corresponding electrical connector at an area of contact, further wherein the first and second plurality of electrical conductors are adapted to minimize electrical resistance at the area of contact due to skin effect.

9. The system as recited in claim 1, wherein each electrical connector comprises a flexible cover, the electrical cover being an electrical insulator.

10. The system as recited in claim 1, comprising an insulation blanket, wherein the insulation blanket comprises a mat of silica fiber insulation within a woven silica blanket, wherein the insulation blanket is sized for use with a pipe of a specific diameter.

11. The system as recited in claim 10, wherein the insulation blanket comprises a plurality of high temperature straps secured to the woven silica blanket.

12. An induction heating system, comprising:

a power source;

a cooling unit operable to remove heat from a cooling fluid, a flexible induction heating cable, comprising:

an electrical conductor disposed within a hollow interior of the flexible induction heating cable to produce a magnetic field with electric current provided by the power source;

a first electrical connector electrically coupled to the electrical conductor, the first electrical connector being adapted for locking engagement with a second electrical connector electrically coupled to the power source; and a first quick-disconnect fluid connector fluidicly coupled to the hollow interior of the flexible induction heating cable.

13. The system as recited in claim 12, wherein the electrical conductor comprises a litz wire.

14. The system as recited in claim 13, comprising a coupling hose adapted to fluidicly couple the flexible induction heating cable with the flexible extension cable.

15. The system as recited in claim 14, wherein the coupling hose comprises a second quick-disconnect fluid connector adapted to securingly engage the first quick-disconnect fluid connector without use of a tool.

16. The system as recited in claim 12, comprising a flexible extension cable operable to convey cooling fluid and conduct electric current to the flexible induction heating cable.

17. The system as recited in claim 16, wherein the flexible extension cable comprises a litz wire to conduct electric current to the flexible induction heating cable.

18. The system as recited in claim 12, wherein the first electrical connector comprises a first plurality of electrical conductors adapted to come into contact with a second plurality of electrical conductors in the second electrical connector at a region of contact, further wherein the first and second plurality of electrical conductors are adapted to minimize resistance between the first and second plurality of electrical conductors at the region of contact due to skin effect.

19. The system as recited in claim 12, wherein the first and second electrical connectors each comprise a flexible electrically insulative cover, the flexible electrically insulative covers covering the first and second plurality of conductors when the first and second electrical connectors are lockingly engaged.

20. The system as recited in claim 12, comprising an insulation blanket, wherein the insulation blanket comprises a mat of continuous filament silica fiber insulation within a woven silica blanket, wherein the insulation blanket is adapted to be wrapped around a workpiece of a specific size and shape.

21. The system as recited in claim 20, wherein the insulation blanket is adapted to be wrapped around a pipe of a specific diameter so as to minimize variations in insulation blanket thickness around the pipe.

22. An induction heating system, comprising:

a power source;

a cooling unit operable to circulate cooling fluid through the induction heating system, a flexible fluid-cooled induction heating cable, comprising:

an electrical conductor disposed within a hollow interior of the induction heating cable;

a first electrical connector electrically coupled to the electrical conductor; and a first fluid connector fluidicly coupled to the hollow interior of the flexible fluid-cooled induction heating cable;

an extension cable operable to convey cooling fluid and conduct electricity to the fluid-cooled induction heating cable, the extension cable having a second fluid connector; and a first fluid hose adapted to fluidicly couple the first fluid connector to the second fluid connector.

23. The system as recited in claim 22, wherein the electrical conductor comprises a litz wire.

24. The system as recited in claim 22, wherein the extension cable comprises a litz wire adapted to conduct electricity through the extension cable to the fluid-cooled induction heating cable.

25. The system as recited in claim 22, further comprising a second fluid hose, the second fluid hose being adapted to fluidicly couple the hollow interior of the flexible fluid-cooled induction heating cable to the extension cable to convey cooling fluid from the flexible fluid-cooled induction heating cable.

26. The system as recited in claim 22, wherein the extension comprises a second electrical connector, the first and second electrical connectors being adapted for locking engagement.

27. The system as recited in claim 22, wherein the first electrical connector comprises a first electrical conductor biased to engage a second electrical conductor in the second electrical connector to increase contact area between the first and second electrical conductors.

28. The system as recited in claim 27, wherein both the first and the second electrical connectors comprise a flexible insulative cover adapted to cover the first and second electrical conductors.

29. The system as recited in claim 22, comprising an insulation blanket adapted for use with a workpiece of a specific size.

30. The system as recited in claim 22, comprising an insulation blanket adapted to be placed around a pipe of a specific diameter and have a uniform thickness around the pipe.

31. A method of inductively heating a workpiece, comprising:

routing a flexible fluid-cooled induction heating cable around the portion of the workpiece to be heated;

connecting electrical connectors located at opposite ends of the flexible fluid-cooled induction heating cable to opposing electrical connectors electrically coupleable to an electrical power source; and coupling fluid connectors located apart from each electrical connector on the flexible fluid-cooled induction heating cable to fluid hoses, wherein each fluid connector is coupled to each fluid hose separately from each electrical connector being connected to an opposing electrical connector.

32. The method as recited in claim 31, comprising placing a temperature feedback device on to workpiece.

33. The method as recited in claim 31, comprising disposing an insulation blanket around a portion of the workpiece to be heated.

34. The method as recited in claim 33, further comprising placing a temperature feedback device on an outer portion of the workpiece and disposing the insulation blanket over the temperature feedback device.

35. The method as recited in claim 31, wherein the workpiece is a pipe having a first diameter.

36. The method as recited in claim 35, wherein disposing comprises identifying to diameter of the pipe to be inductively heated and selecting an insulation blanket sized specifically for being disposed around a pipe of that diameter.

37. The method as recited in claim 31, wherein routing comprises wrapping the flexible fluid-cooled induction heating cable around the portion of the workpiece to be heated to form an inductive coil.

38. The method as recited in claim 31, wherein connecting comprises connecting the electrical connectors to opposing electrical connectors of a flexible extension cable electrically coupleable to an electrical power source.

39. The method as recited in claim 38, wherein coupling comprises coupling the fluid hoses to fluid connectors located on the flexible extension cable.

40. The method as recited in claim 31, wherein connecting comprises lockingly securing the electrical connectors to the opposing electrical connectors without using a tool.

41. The method as recited in claim 31, wherein the flexible fluid-cooled induction heating cable is operable to be repositioned by hand at any point during the heating of the workpiece without securing power to the flexible fluid-cooled induction heating cable.

42. The method as recited in claim 31, wherein the temperature feedback device comprises a plurality of temperature feedback devices positioned at various locations on the portion to be heated, wherein the flexible induction heating cable is operable to be repositioned in response to temperature information received from the temperature feedback devices without securing power to the flexible fluid-cooled induction heating cable.

* * * * *